US012161213B2

(12) United States Patent
Varale et al.

(10) Patent No.: US 12,161,213 B2
(45) Date of Patent: Dec. 10, 2024

(54) SINGLE-PIECE MOULDED CONTAINER FOR PACKAGING A PRODUCT

(71) Applicant: L'Oreal, Paris (FR)

(72) Inventors: Aditya Varale, Mumbai (IN); Venkatesh Sheregar, Shanghai (CN)

(73) Assignee: L'Oreal, Paris (FR)

( * ) Notice: Subject to any disclaimer, the term of this patent is extended or adjusted under 35 U.S.C. 154(b) by 113 days.

(21) Appl. No.: 17/906,804

(22) PCT Filed: Mar. 15, 2021

(86) PCT No.: PCT/EP2021/056493
§ 371 (c)(1),
(2) Date: Sep. 20, 2022

(87) PCT Pub. No.: WO2021/190972
PCT Pub. Date: Sep. 30, 2021

(65) Prior Publication Data

US 2023/0210243 A1 Jul. 6, 2023

(30) Foreign Application Priority Data

Mar. 23, 2020 (IN) ..... 202021012636
Aug. 21, 2020 (FR) ..... 2008614

(51) Int. Cl.
*A45D 40/22* (2006.01)
*B65D 43/16* (2006.01)

(52) U.S. Cl.
CPC ..... *A45D 40/221* (2013.01); *A45D 40/222* (2013.01); *B65D 43/162* (2013.01);
(Continued)

(58) Field of Classification Search
CPC ..... B65D 43/162; A45D 2040/225; A45D 2040/226; A45D 40/221
(Continued)

(56) References Cited

U.S. PATENT DOCUMENTS 1,847,949 A * 3/1932 Kasdan ..... A45D 33/025 132/299
3,876,071 A 4/1975 Lloyd et al.
(Continued)

FOREIGN PATENT DOCUMENTS

GB 2022555 A 12/1979

OTHER PUBLICATIONS

International Search Report for PCT/EP2021/056493 mailed Jun. 11, 2021.

*Primary Examiner* — Ernesto A Grano
(74) *Attorney, Agent, or Firm* — CHRISTENSEN O'CONNOR JOHNSON KINDNESS PLLC

(57) ABSTRACT

Single-piece moulded container (10) for packaging at least one product comprising a cover (20), a base (30) and a hinge platform (40) pivotably connecting said base (30) to said cover (20), wherein the hinge platform (40) comprises: —a first hinge (41) connected to a first surface (35) of the base (30) and designed to pivot the cover (20) compared to the base (30) from an initial moulding flat position, in which the cover (20) forms a first angle with the base (30), to an opened position of use in which the cover (20) forms a second angle with the base (30); and—a second hinge (42) connected to a first surface (25) of the cover (20) and designed to pivot the cover (20) compared to the base (30) from the opened position of use to a closed position in which the cover (20) covers the base (30). The first surface (25) of the cover (20), the first surface (35) of the base (30) and the hinge platform (40) being in the same plane in the moulding flat position.

18 Claims, 7 Drawing Sheets

(52) U.S. Cl.
CPC .. *A45D 2040/223* (2013.01); *A45D 2040/224* (2013.01); *A45D 2040/226* (2013.01)

(58) Field of Classification Search
USPC ..... 220/836
See application file for complete search history.

(56) References Cited

U.S. PATENT DOCUMENTS

| | | | | |
|---|---|---|---|---|
| 4,011,940 | A | 4/1977 | Lloyd et al. | |
| 4,102,452 | A | 7/1978 | Masaaki et al. | |
| 4,363,406 | A | 12/1982 | Raucci et al. | |
| 4,365,711 | A | 12/1982 | Long et al. | |
| 8,118,040 | B2 * | 2/2012 | Bennett | A45D 33/16 132/307 |
| 9,095,198 | B2 * | 8/2015 | Apodaca | A45D 33/02 |
| 10,327,533 | B2 * | 6/2019 | Cicchetti | A45D 40/221 |
| 2002/0157684 | A1 * | 10/2002 | Sebban | A45D 40/221 132/301 |
| 2002/0162565 | A1 * | 11/2002 | Sebban | A45D 40/221 132/293 |
| 2010/0307530 | A1 * | 12/2010 | Bennett | A45D 33/16 132/307 |
| 2011/0049150 | A1 * | 3/2011 | Liston | B65D 43/162 220/260 |
| 2019/0029400 | A1 * | 1/2019 | Carraro | A45D 33/008 |
| 2019/0110578 | A1 * | 4/2019 | Maurin | A45D 40/24 |
| 2019/0246770 | A1 * | 8/2019 | Delbove | A45D 33/003 |
| 2023/0276920 | A1 * | 9/2023 | Lan | A45D 33/006 132/293 |

* cited by examiner

SINGLE-PIECE MOULDED CONTAINER FOR PACKAGING A PRODUCT

CROSS-REFERENCES TO RELATED APPLICATIONS

This application is the National Phase of International Application No. PCT/EP2021/056493, filed Mar. 15, 2021, which claims the benefit of Indian Application No. 202021012636, filed Mar. 23, 2020 and French Application No. 2008614, filed Aug. 21, 2020, the entire disclosure of which is hereby incorporated by reference herein for all purposes.

The present invention relates to the general field of containers for packaging and dispensing a cosmetic product.

The expression "cosmetic product" is understood to mean a product as defined in Article 2 of Regulation No. 1223/2009 of the European Parliament and of the Council of 30 Nov. 2009.

More particularly, the container according to the present invention is designed for packaging a cosmetic product such as, for example, a make-up product, for example an anhydrous product, in form of compact power, or a pasty product intended to be applied, for example on the user's epidermis. The product may be for example an eye shadow, a blusher or a foundation or any other product.

The invention relates to a packaging and dispensing device having an upper cap pivotably mounted on a base.

Referenced can be made to document U.S. Pat. No. 6,901,937-B2 which describes a make-up case having a bottom and a lid capable of pivoting with respect to the bottom between a position underneath the bottom, an intermediate position in which the lid is at 120° from the bottom and a closed position in which the lid covers the bottom. The case comprises an intermediate element connected to the bottom by a first hinge having a hinge pin forming a first axis of articulation. The intermediate element is further connected to the lid by a second hinge having a hinge pin forming a second axis of articulation. To keep the lid in position underneath the bottom, the intermediate element comprises two horizontal protruding pins designed to cooperate with a corresponding horizontal recess provided on the lateral wall of the lid. Those pins may also be used to cooperate with corresponding horizontal recess provided on the lateral wall of the bottom to maintain the lid in the intermediate and closed position. The horizontal pins cooperating with the corresponding recess are reversible fastening elements.

Such make-up case has a plurality of distinct parts. Furthermore, the mould needed to mould the base and the bottom necessitates sliders apart from the core itself to form the horizontal recesses, which leads a complex mould.

Reference can also be made to document US 2002/0162565-A1 which describes a case for packaging a product comprising a base and a lid articulated on the base via an intermediate element capable of pivoting so as to allow the lid to pivot through 360° relative to the base. The intermediate element comprises a locking bar protruding vertically from the intermediate element and designed to cooperate with an elongated opening provided on a lateral wall of the base.

The case disclosed in this document also requires a transverse moving insert for moulding and demoulding the elongated opening, thus requires a complex mould structure.

There is thus a need to provide a low-cost container and easy to manufacture.

One aim of the present invention is to provide a device for packaging and dispensing at least one product of simple structure, easy to manufacture and ergonomic.

The object of the present invention is to provide a single-piece moulded container for packaging at least one product comprising a cover, a base and a hinge platform pivotably connecting said base to said cover.

The hinge platform comprises a first hinge connected to a first surface of the base and designed to pivot the cover compared to the base from an initial moulding flat position, in which the cover forms a first angle with the base, to an opened position of use in which the cover forms a second angle with the base.

The first surface of the base is the lower surface of the base in both moulding flat position and opened position.

The hinge platform further comprises a second hinge connected to a first surface of the cover and designed to pivot the cover compared to the bottom from the opened position of use to a closed position in which the cover covers the base.

The first surface of the base and the hinge platform being in the same plane in the moulding flat position.

The first surface of the cover is the lower surface of the cover in the moulding flat position and becomes the upper surface of the cover when pivoting the cover in the closed position.

The height of the container in the closed position is delimited by the first surface of the cover and the first surface of the base.

In other words, the hinge platform connects both cover and base at their bottoms in the initial moulding position, which makes the hinges along the same line or plane and allows to have a flat shape mould, and thereby reducing the moulding material required and the manufacturing cost of the container.

Advantageously, the single-piece moulded container comprises a single snapping line between the base and the hinge platform.

The snapping is not easily reversible, thereby preventing the user to open the snap.

The single snapping line may comprise two opposite vertical snap beads provided in a vertical cut out located in a rear wall of the base and a snapping member protruding vertically from an upper surface of the hinge platform in the moulding position and designed to cooperate with the vertical snap beads in the opened position.

Thanks to the snap beads provided directly in the base and extending in a vertical direction, the snapping force is significant and does not allow the user to easily move the cover from the opened position to the moulding flat position.

The rear wall of the base is perpendicular to the first surface of the base.

Furthermore, the mould used to mould the container is of simple structure since the snap beads protrudes in a direction parallel to the core of the mould. The container may thus be moulded into the same core without any additional sliders.

For example, the snapping member comprises an elongated portion or bar or rib along the width of the platform and comprises, at its two opposite edges, a fastening member having a groove designed to cooperate with the corresponding vertical snap bead in the opened position.

In said opened position, the grooves extend along the vertical axis. In the opened position, the elongated portion completely covers the first hinge.

Each groove of the fastening members may have a depth comprised between 0.55 mm and 0.65 mm, for example equal to 0.6 mm and a length comprised between 0.2 mm and 0.23 mm.

For example, each two vertical snap beads extend along at least a part of the height of the base and protrudes towards each other.

Each snap bead has, in cross-section, for example a rounded-edge shape. In a general way, each snap bead has a shape matting the shape of the grooves of the fastening member.

According to another embodiment, the single snapping line comprises two opposite vertical snap grooves provided in a cut out located in a rear wall of the base and a snapping member protruding vertically from an upper surface of the hinge platform in the moulding position and designed to cooperate with the vertical snap grooves in the opened position.

For example, the snapping member comprises an elongated portion or bar or rib along the width of the platform and comprises, at its two opposite edges, a fastening member having a rib designed to cooperate with the corresponding vertical snap groove (132*b*) in the opened position.

In the moulding position, the ribs may protrude along the transversal axis away from the snapping member in two opposite directions.

Each rib may comprise a flat surface for better resistance to de-snapping of said rib from the corresponding groove.

In said opened position, the ribs extend along the longitudinal axis X and in the closed position, the ribs extend along the vertical axis.

The elongated portion of the snapping member may comprise a transversal recess.

Advantageously, each two vertical snap groove extends along the whole height of the base.

Each two vertical snap groove may have, in cross-section, a parallelepiped shape designed to match with a corresponding shape on the snapping member.

For example, the cover is delimited by a front wall, a rear wall, opposite to the front wall, two lateral walls and a bottom or lower surface delimiting an inner cavity for receiving for example a mirror and/or an application member.

For example, the front wall comprises a protruding element protruding along the longitudinal axis towards the outside of the cover and designed to engage with a corresponding notch provided on the front wall of the base in order to reversible lock the cover on the base.

For example, the base is delimited by a front wall a rear wall, opposite to the front wall, two lateral walls and a bottom or lower surface delimiting an inner cavity for receiving the product.

In the closed position, the front wall of the cover is advantageously aligned with the front wall of the base and the rear wall of the cover is aligned with the rear wall of the base.

The rear wall, notably at its rear edge, of the base may have a rounded cut out to ensure that the cover does not scrape the base while the rotational movement of the cover from the opened to the closed position and vice-versa.

The first angle may be equal to 180°.

The second angle may be comprised between 90° and 150°, for example equal to 120°.

For example, both first and second hinges are of the dead hinge type.

For example, both first and second hinges have a U-shaped transversal groove provided on the upper surface of the hinge platform and a V-shaped transversal notch provided on the lower surface of the hinge platform, opposite to the upper surface.

Each V-shaped transversal notch may have an angle comprised between 100° to 140°, for example equal to 120°. Each of the V-shape transversal notches may have a 0.1 mm depth cut in order to make sure the corresponding hinge turns at the exact centre without creating a distorted fracture line.

The present invention will be better understood from studying the detailed description of an embodiment considered by way of a non-limiting example and illustrated by the attached drawings in which.

Figure 11:
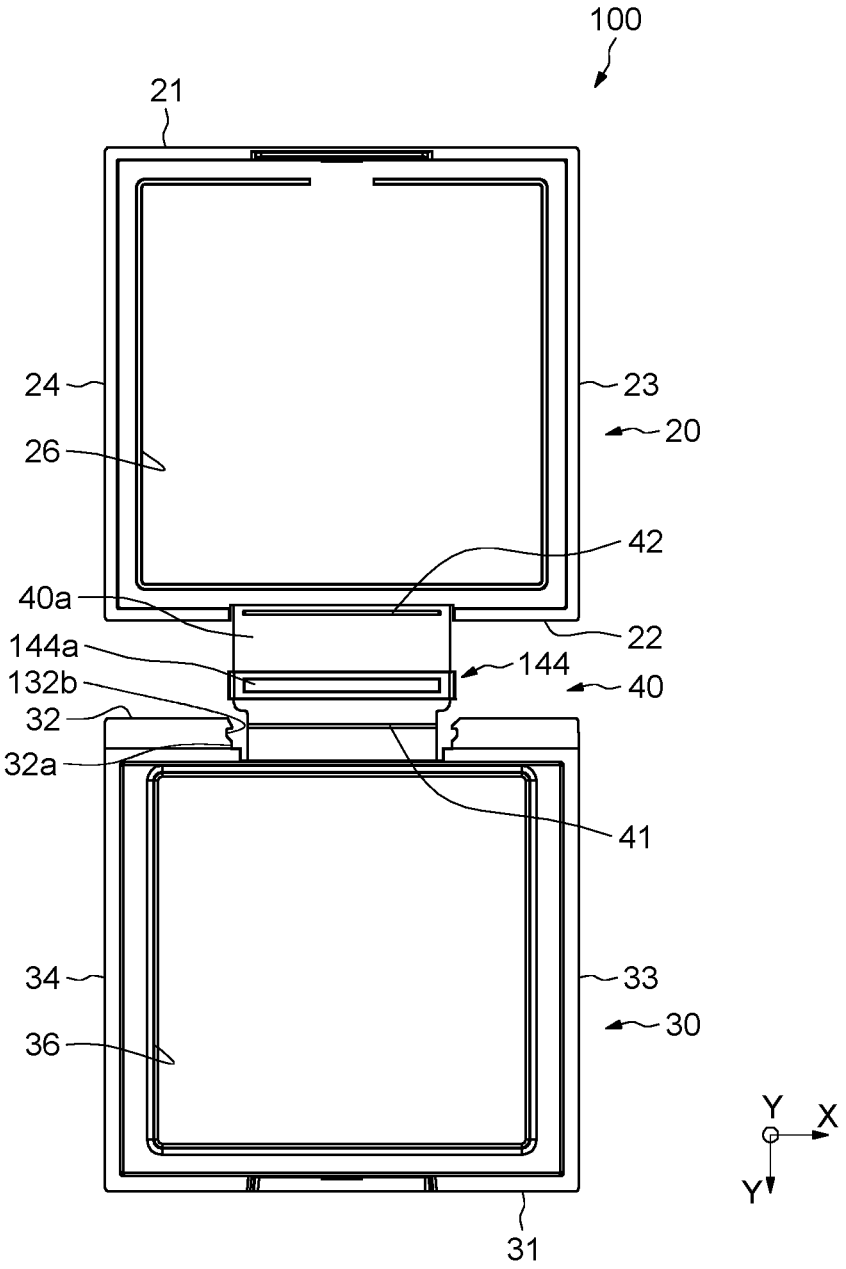
Figure 12:
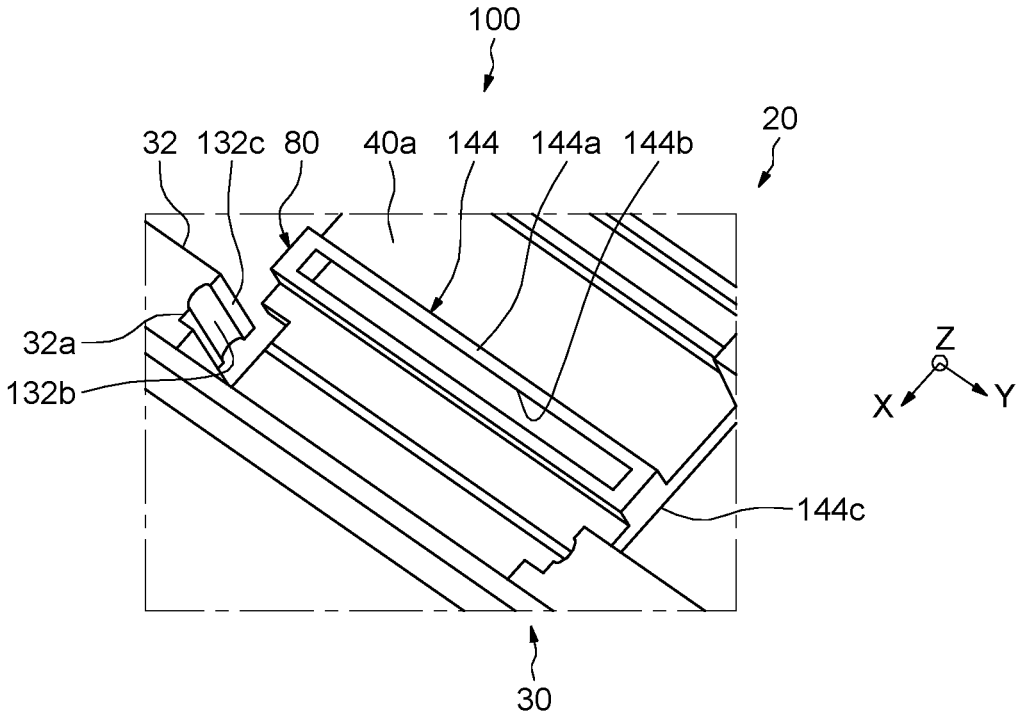

FIG. 11 a front view of a device according to a second embodiment of the present invention, in a moulding position;

FIG. 12 is a detail view of the device of FIG. 11; and

Figure 13:
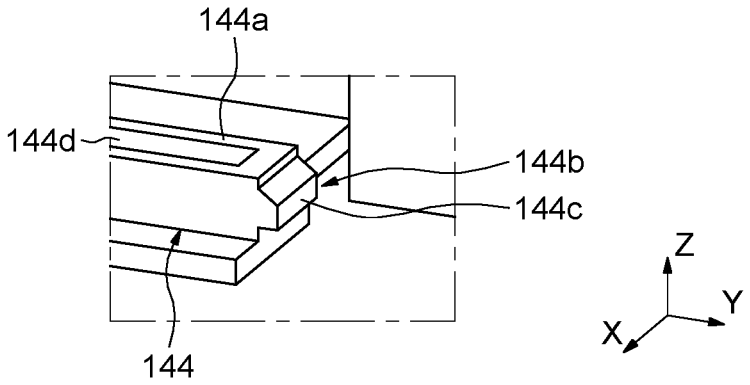

FIG. 13 is a detail view of the bar of the device of FIGS. 11 and 12.

In the following description, the terms "longitudinal, "transversal", "vertical", "front", "rear", "left" and "right" are defined according to a usual orthogonal benchmark as shown on the drawings, which includes:

- a longitudinal axis X, horizontal and rear to the front left to the right of upper views;
- a transversal axis Y, perpendicular to the longitudinal axis X and extending from the left to the right of the upper views; and
- a vertical axis Z, orthogonal to the longitudinal and transversal axis X and Y.

FIGS. 1 to 10 show an example of a device 10 for packaging a product, such as for example dry powders, wet powders or hot pour products.

The device or container 10 comprises a cover or lid 20 and a base 30 connected to the cover 20 by an intermediate element or a hinge platform 40.

The device 10 is a single piece moulded flat, as shown on FIGS. 1 to 4 and 7.

The cover 20 is delimited by a front wall 21, a rear wall 22, opposite to the front wall 21, two lateral walls 23, 24 and a bottom or lower surface 25 delimiting an inner cavity 26 for receiving for example a mirror and/or an application member (not shown).

The front wall 21 comprises a protruding element 21*a* protruding along the longitudinal axis X towards the outside of the cover 20 and designed to engage with a corresponding notch 31*a* provided on a front wall 31 of the base 30 in order to reversible lock the cover 20 on the base 30.

The base 30 is delimited by a front wall 31, a rear wall 32, opposite to the front wall 31, two lateral walls 33, 34 and a bottom or lower surface 35 delimiting an inner cavity 36 for receiving the product.

The hinge platform 40 comprises a first hinge 41 connected to the bottom 35 of the base 30 and a second hinge 42 connected to the bottom 25 of the cover 20. This allows to have a flat shape mould, which simplifies the mould and reduces the amount of material needed for the mould.

The hinges 41, 42 are of the dead hinge type, such as a U-shaped transversal groove provided on the upper surface 40*a* of the hinge platform 40. The hinges are further designed with a V-shape transversal notch 41*a*, 42*a* provided on the lower surface 40*b* of the hinge platform 40, as shown on FIG. 9.

The notch has an angle β comprised between 100° to 140°, for example equal to 120°. Each of the notches 41*a*, 42*a* have a 0.1 mm depth cut in order to make sure the corresponding hinge turns at the exact centre without creating a distorted fracture line.

Figure 1:
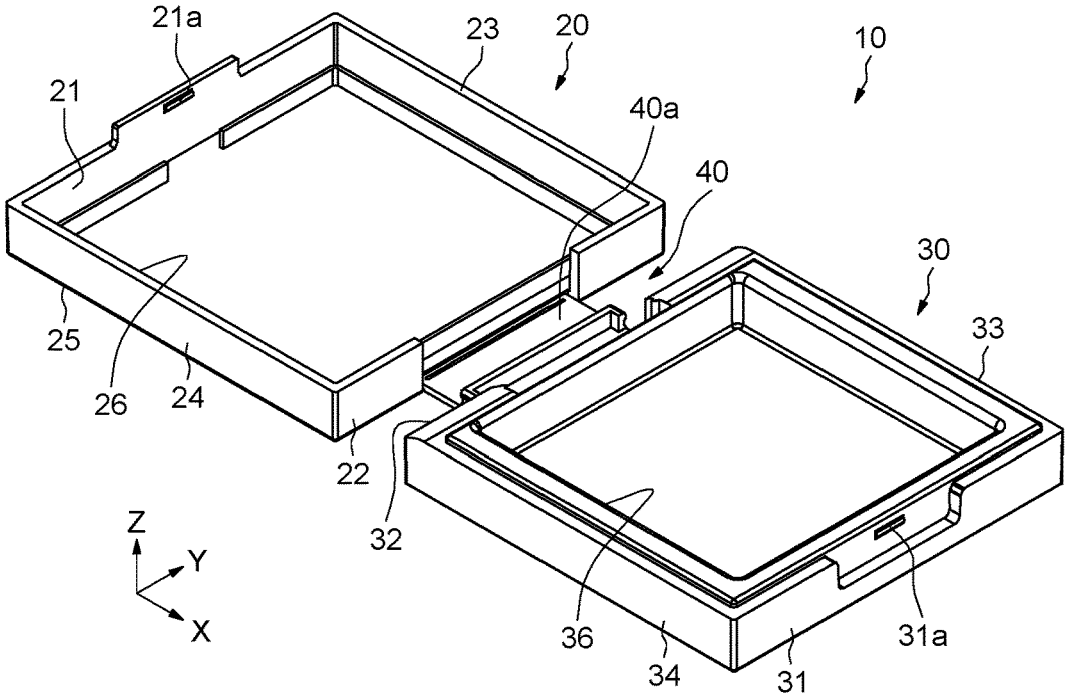
FIG. 1 is a perspective upper view of a device according to an embodiment of the present invention, in a moulding position.
Figure 2:
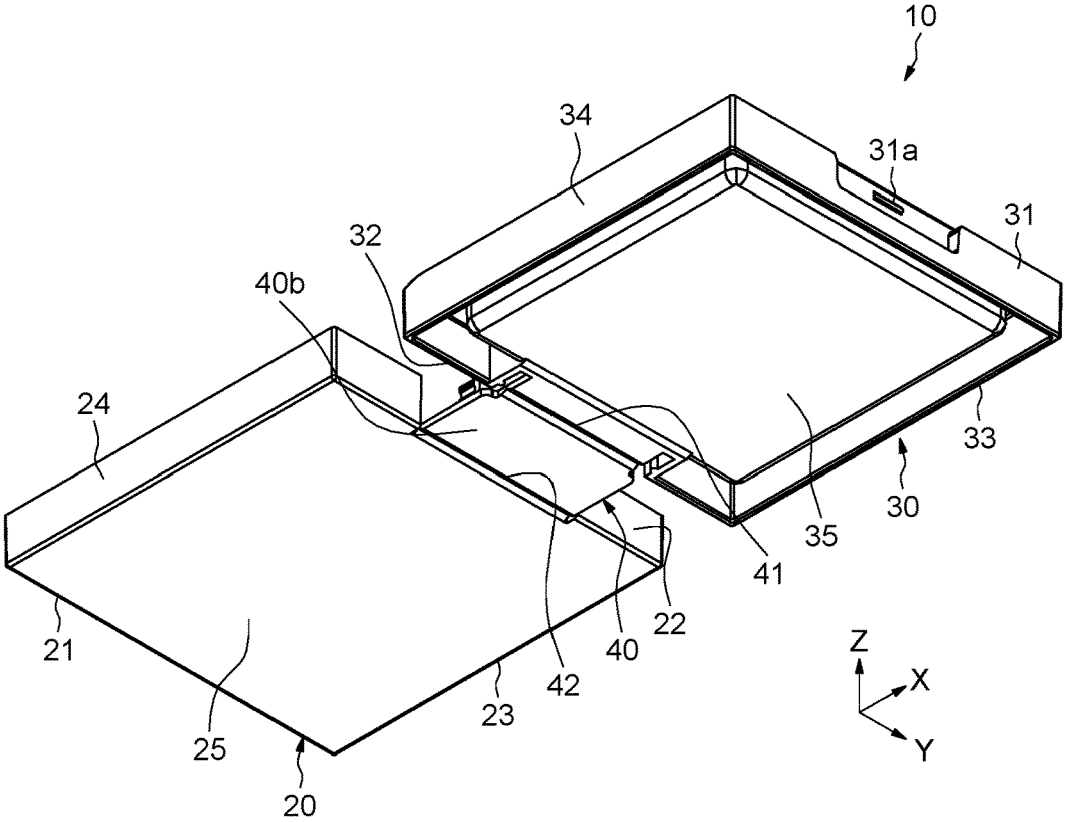
FIG. 2 is perspective lower view of the device of FIG. 1, in the moulding position.
Figure 3:
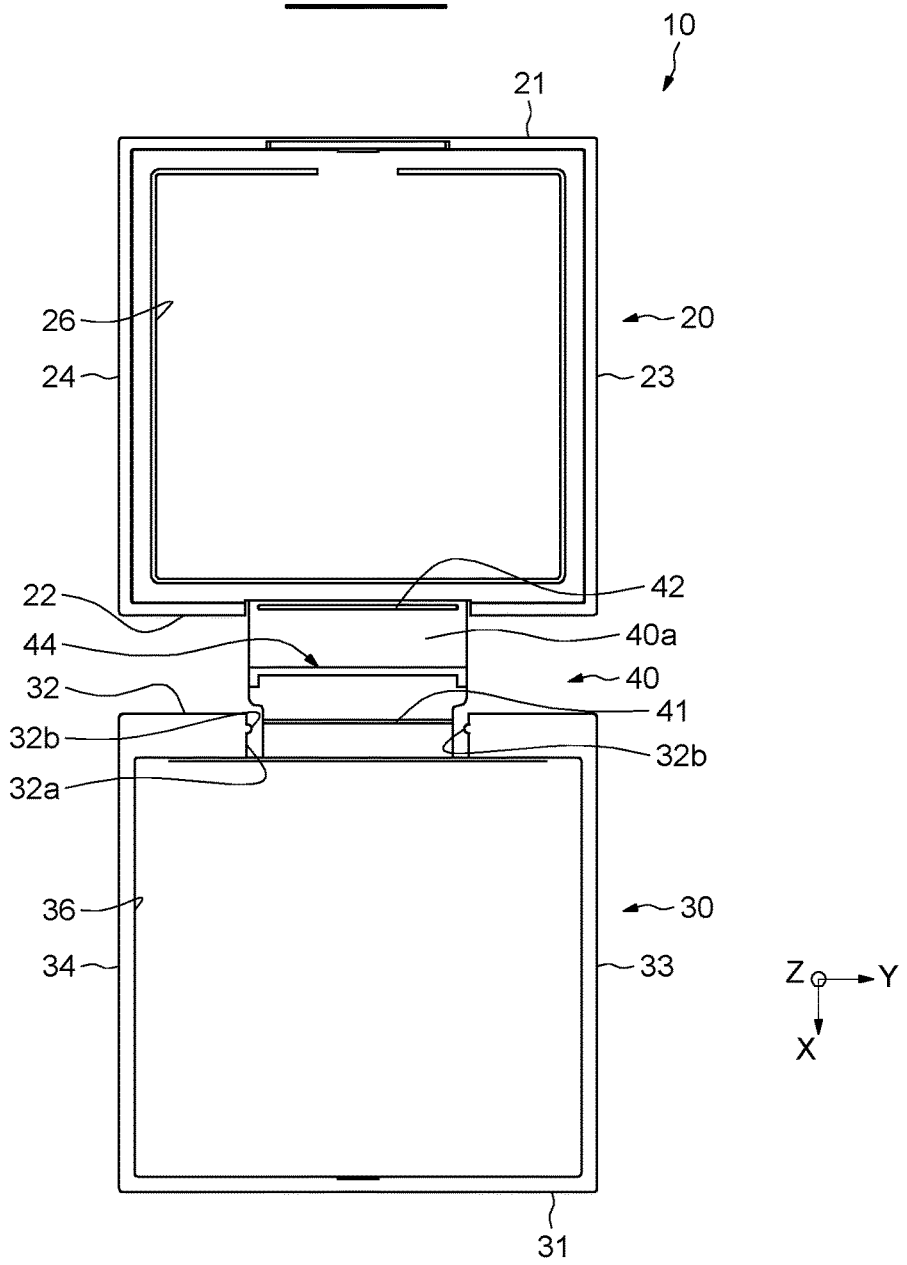
FIG. 3 is a front view of the device of FIG. 1, in the moulding position.
Figure 4:
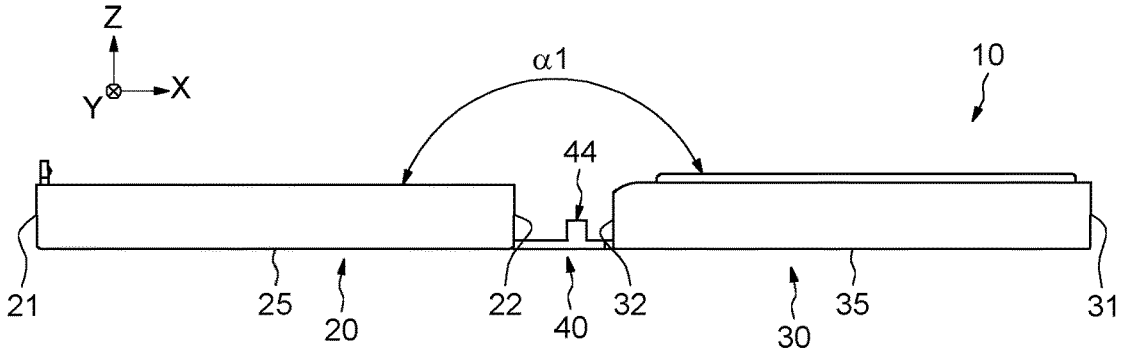
FIG. 4 is a side view of the device of FIG. 1, in the moulding position.
Figure 5:
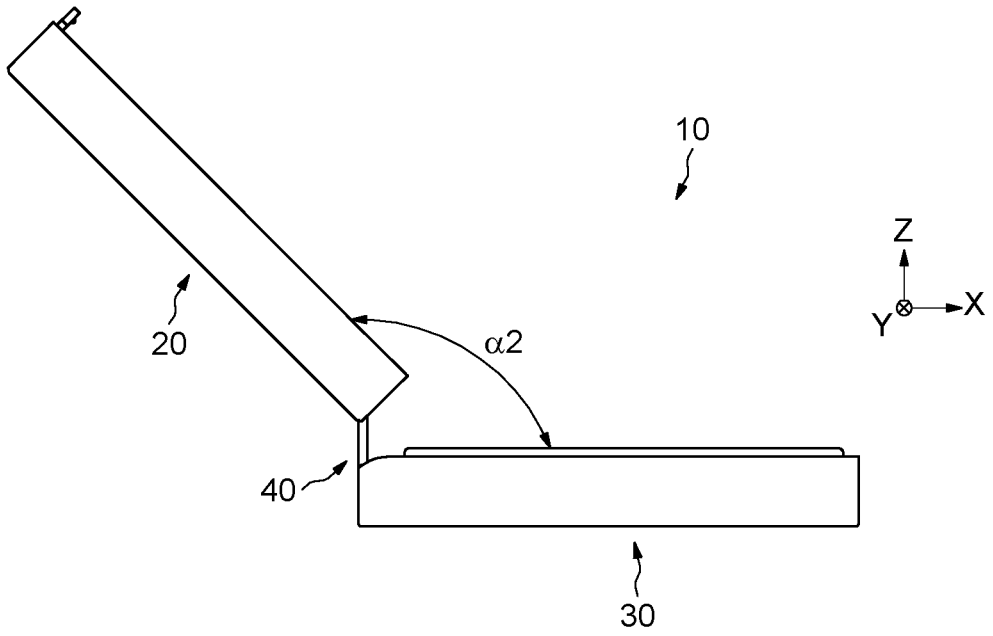
FIG. 5 is a side view of the device of FIG. 1, in an opened position.

The first hinge 41 is designed to pivot the cover 20 compared to the bottom 30 from an initial moulding flat position, shown on FIGS. 1 to 4 in which the cover 20 forms a first angle α1 equal to 180° with the bottom 30 to an opened position of use as shown in FIG. 5, in which the cover 20 forms a second angle α2 comprised between 90° and 150°, for example equal to 120° with the bottom 30.

Figure 6:
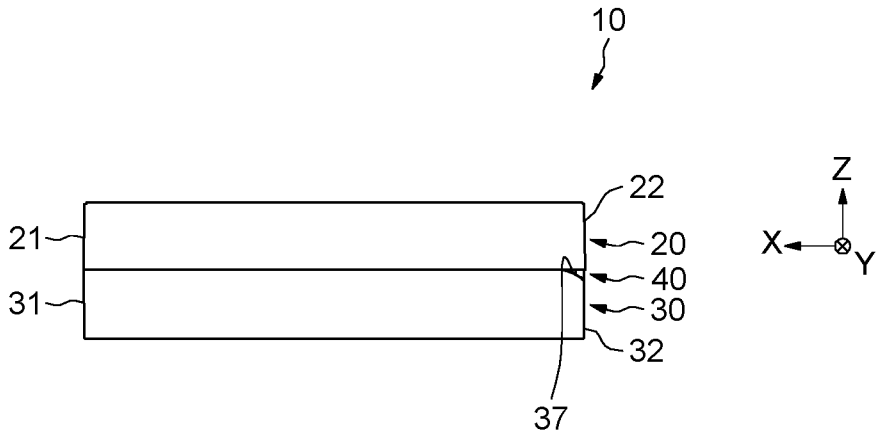
FIG. 6 is a side view of the device of FIG. 1, in a closed position.

The second hinge 42 is designed to pivot the cover 20 compared to the bottom 30 from the opened position of use to a closed position in which the cover 20 covers the bottom 30, as shown on FIG. 6.

The hinge platform 40 connects both cover and base at their bottoms, which makes the hinges along the same line and helps reducing the mould area, and thereby the moulding material required.

In the closed position, the front wall 21 of the cover 20 is aligned with the front wall 31 of the base 30 and the rear wall 22 of the cover 20 is aligned with the rear wall 32 of the base 30.

The rear edge of the base 30 has a rounded cut out 37 to ensure that the cover 20 does not scrape the base 30 while the rotational movement of the cover 20 from the opened to the closed position and vice-versa. The rounded cut out 37 is shown on FIG. 6.

Figure 7:
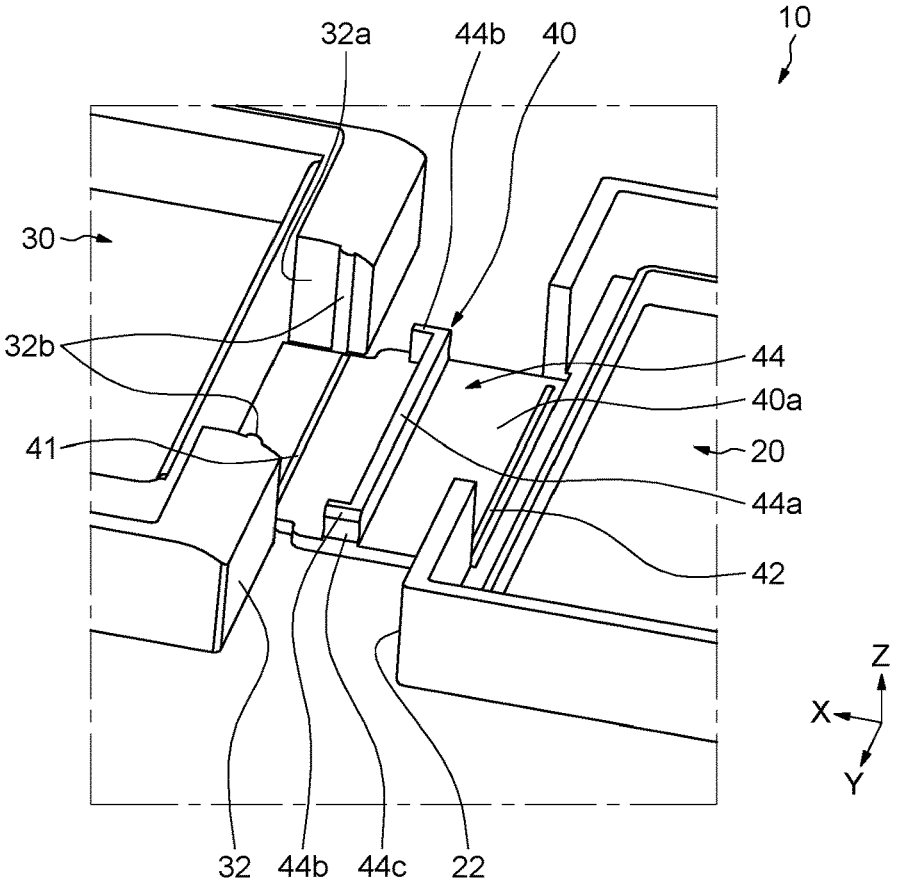
FIGS. 7 to 9 are detailed views of a hinge platform of the device of FIG. 1.

As illustrated in detail on FIG. 7, the rear wall 32 of the base 30 comprises a vertical cut out 32*a* provided with two vertical snap beads 32*b* along the whole height of the bottom 30 and protruding towards each other. Each snap beads 32*b* has a rounded-edge shape.

The hinge platform 40 comprises a snapping member 44 protruding vertically from the upper surface 40*a* of the hinge platform 40 in the moulding position. The snapping member 44 has an elongated portion 44*a* along the width of the platform 40 and comprises, at its two opposite edges, a fastening member 44*b* having a groove 44*c* designed to cooperate with the corresponding vertical snap bead 32*b* in the opened position. In said opened position, the grooves 44*c* extend along the vertical axis Z, as can be seen on FIG. 10. In the opened position, the elongated portion 44*a* completely covers the first hinge 41.

The device thus only comprises one snapping point, made by the vertical snap beads 32*b* and the snapping member 44 between the hinge platform 40 and the base 30.

Figure 8:
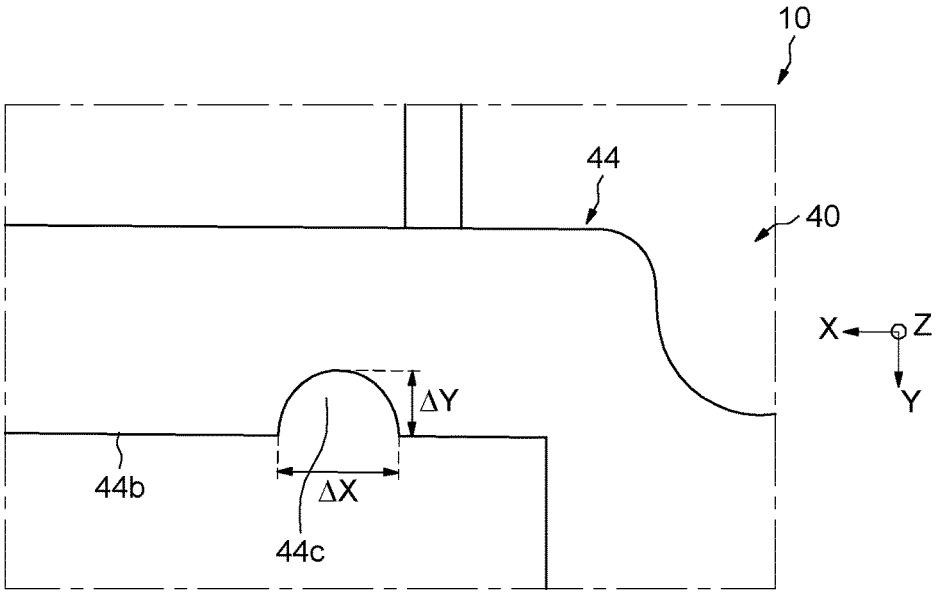
Figure 9:
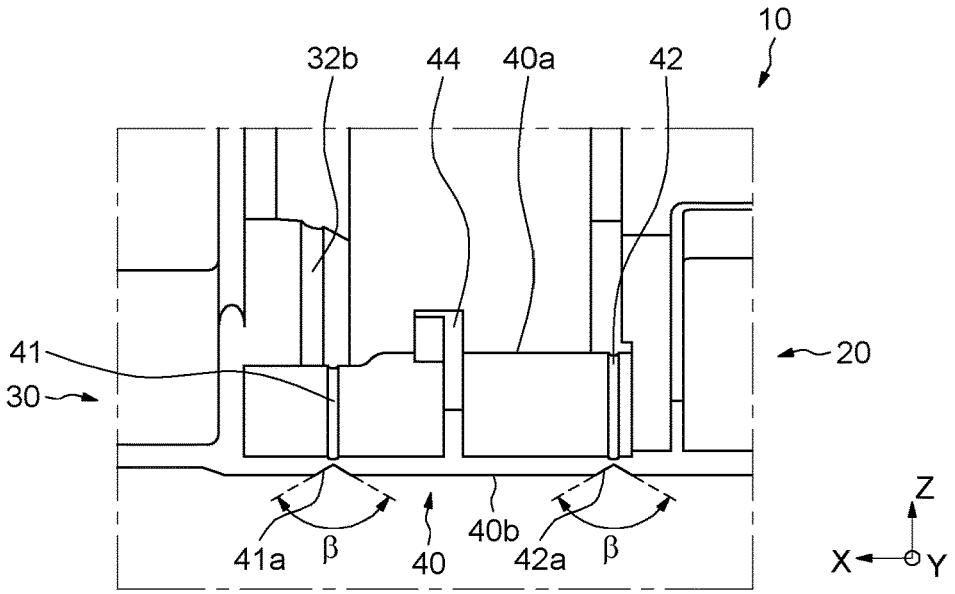
Figure 10:
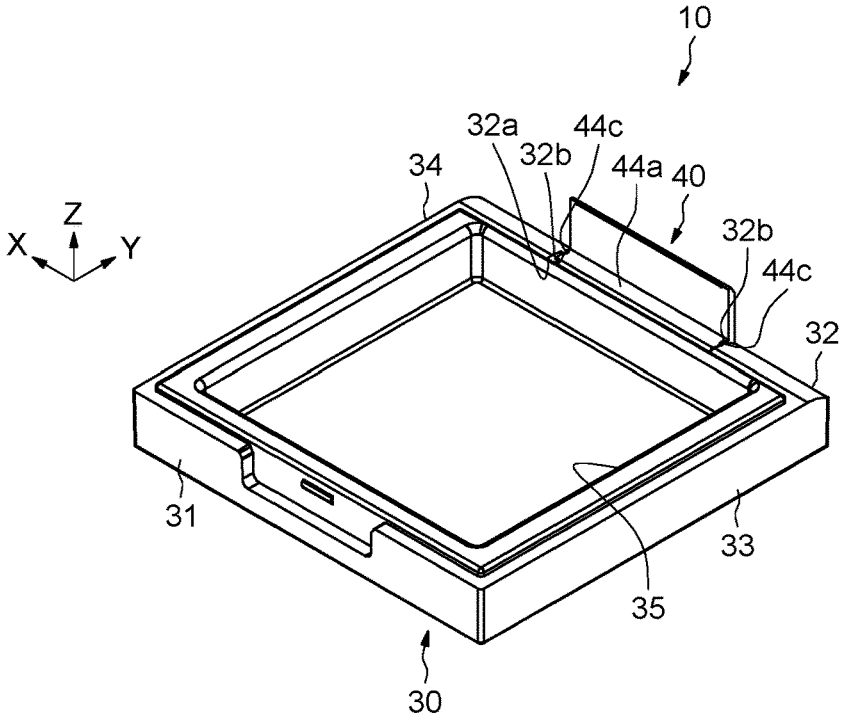
FIG. 10 shows the hinge platform in the opened position.

The grooves 44*c* of the fastening members 44*b* are detailed according to FIG. 8. Each groove 44*c* has a depth ΔY comprised between 0.55 mm and 0.65 mm, for example equal to 0.6 mm and a length ΔX comprised between 0.2 mm and 0.23 mm.

As shown on FIGS. 11 to 13, in which the same elements bear the same references, the device 100 for packaging a product differs from the embodiment of FIGS. 1 to 10 only by the shape of the As illustrated in detail on FIG. 12, the rear wall 32 of the base 30 comprises a vertical cut out 32*a* provided with two vertical snap grooves 132*b* along the whole height of the bottom 30. Each snap groove 132*b* has, in cross-section, a parallelepiped shape designed to match with a corresponding shape on the snapping member 144.

The hinge platform 40 comprises a snapping member 144 protruding vertically from the upper surface 40*a* of the hinge platform 40 in the moulding position. As shown in detail on FIG. 13, the snapping member 144 has an elongated portion 144*a* along the width of the platform 40 and comprises, at its two opposite edges, a fastening member 144*b* having a rib 144*c* designed to cooperate with the corresponding vertical snap groove 132*b* in the opened position. The ribs 144*c* protrudes along the transversal axis Y away from the snapping member 144 in two opposite directions.

Each rib 144*c* comprises a flat surface for better resistance to de-snapping of said rib from the corresponding groove 132*b*.

In said opened position, the ribs 144*c* extend along the longitudinal axis X, as can be seen on FIGS. 11 and 12. In the closed position, the ribs 144*c* extend along the vertical axis Z.

The elongated portion 144 of the snapping member 144 comprises a transversal recess 144*d*.

The device thus only comprises one snapping point, made by the vertical snap grooves 32*b* and the snapping member 144 between the hinge platform 40 and the base 30.

The devices 10, 100 are each made of plastic material such as for example polypropylene (PP), acrylobutadiene-styrene (ABS) or any material suitable for a make-up case.

Thanks to the snap beads 32*b* or the snap grooves 132*b* provided directly in the base 30 and extending in a vertical direction, the snapping force is significant and does not allow the user to easily move the cover 20 from the opened position to the moulding flat position.

Furthermore, the mould used to mould the container 10, 100 is of simple structure since the snap beads protrudes in a direction parallel to the core of the mould. The container may thus be moulded into the same core without any additional sliders.

The invention claimed is:

1. Single-piece moulded container (10, 100) for packaging at least one product comprising a cover (20), a base (30) and a hinge platform (40) pivotably connecting said base (30) to said cover (20), wherein the hinge platform (40) comprises:

a first hinge (41) connected to a first surface (35) of the base (30) and designed to pivot the cover (20) compared to the base (30) from an initial moulding flat position, in which the cover (20) forms a first angle (α1) with the base (30), to an opened position of use in which the cover (20) forms a second angle (α2) with the base (30);

a second hinge (42) connected to a first surface (25) of the cover (20) and designed to pivot the cover (20) compared to the base (30) from the opened position of use to a closed position in which the cover (20) covers the base (30), the first surface (25) of the cover (20), the first surface (35) of the base (30) and the hinge platform (40) being in the same plane in the moulding flat position; and a single snapping line between the base (30) and the hinge platform (40), wherein the single snapping line comprises two opposite vertical snap beads (32*b*) provided in a cut out (32*a*) located in a rear wall (32) of the base (30) and a snapping member (44) protruding vertically from an upper surface (40*a*) of the hinge platform (40) in the moulding position and designed to cooperate with the vertical snap beads (32*b*) in the opened position.

2. Single-piece moulded container (10) according to claim 1, wherein the snapping member (44) comprises an elongated portion or bar or rib (44*a*) along the width of the platform (40) and comprises, at its two opposite edges, a fastening member (44*b*) having a groove (44*c*) designed to cooperate with the corresponding vertical snap bead (32*b*) in the opened position.

3. Single-piece moulded container (10) according to claim 2, wherein each groove (44*c*) of the fastening members (44*b*) has a depth (ΔY) comprised between 0.55 mm and 0.65 mm, for example equal to 0.6 mm and a length (ΔX) comprised between 0.2 mm and 0.23 mm.

4. Single-piece moulded container (10) according to claim 1, wherein each two vertical snap beads (32*b*) extends along the whole height of the base (30) and protrudes towards each other.

5. Single-piece moulded container (10) according to claim 1, wherein each two vertical snap bead (32*b*) has, in cross-section, a rounded-edge shape.

6. Single-piece moulded container (10, 100) according to claim 1, wherein the first angle (α1) is equal to 180°.

7. Single-piece moulded container (10, 100) according to claim 1, wherein the second angle (α2) is comprised between 90° and 150°.

8. Single-piece moulded container (10, 100) according to claim 7, wherein each V-shaped transversal notch (41*a*, 42*a*) has an angle (B) comprised between 100° to 140°, for example equal to 120°.

9. Single-piece moulded container (10, 100) according to claim 1, wherein the second angle (α2) is equal to 120°.

10. Single-piece moulded container (10, 100) according to claim 1, wherein both first and second hinges (41, 42) have a U-shaped transversal groove provided on the upper surface (40*a*) of the hinge platform (40) and a V-shaped transversal notch (41*a*, 42*a*) provided on the lower surface (40*b*) of the hinge platform (40), opposite to the upper surface (40*a*).

11. Single-piece moulded container (10, 100) according to claim 1, wherein the cover (20) is delimited by a front wall (21), a rear wall (22), opposite to the front wall (21), two lateral walls (23, 24) and the first surface (25) delimiting an inner cavity (26) and the base (30) is delimited by a front wall (31), a rear wall (32), opposite to the front wall (31), two lateral walls (33, 34) and a first surface (35) delimiting an inner cavity (36) for receiving the product, the rear wall (22) of the cover (20) being aligned with the rear wall (32) of the base (30) in the closed position.

12. Single-piece moulded container (10, 100) according to claim 11, wherein the front wall (21) of the base (20) comprises at least one protruding element (21*a*) protruding towards the outside of the cover (20) and designed to engage with a corresponding notch (31*a*) provided on the front wall (31) of the base (30).

13. Single-piece moulded container (10, 100) according to claim 11, wherein the rear wall (32) of the base (30) has a rounded cut out.

14. Single-piece moulded container (10, 100) for packaging at least one product comprising a cover (20), a base (30) and a hinge platform (40) pivotably connecting said base (30) to said cover (20), wherein the hinge platform (40) comprises:

a first hinge (41) connected to a first surface (35) of the base (30) and designed to pivot the cover (20) compared to the base (30) from an initial moulding flat position, in which the cover (20) forms a first angle (α1) with the base (30), to an opened position of use in which the cover (20) forms a second angle (α2) with the base (30);

a second hinge (42) connected to a first surface (25) of the cover (20) and designed to pivot the cover (20) compared to the base (30) from the opened position of use to a closed position in which the cover (20) covers the base (30), the first surface (25) of the cover (20), the first surface (35) of the base (30) and the hinge platform (40) being in the same plane in the moulding flat position; and a single snapping line between the base (30) and the hinge platform (40), wherein the single snapping line comprises two opposite vertical snap grooves (132*b*) provided in a cut out (32*a*) located in a rear wall (32) of the base (30) and a snapping member (144) protruding vertically from an upper surface (40*a*) of the hinge platform (40) in the moulding position and designed to cooperate with the vertical snap grooves (132*b*) in the opened position.

15. Single-piece moulded container (100) according to claim 14, wherein the snapping member (144) comprises an elongated portion or bar or rib (144*a*) along the width of the platform (40) and comprises, at its two opposite edges, a fastening member (144*b*) having a rib (144*c*) designed to cooperate with the corresponding vertical snap groove (132*b*) in the opened position.

16. Single-piece moulded container (100) according to claim 15, wherein each rib (144*c*) comprises a flat surface.

17. Single-piece moulded container (100) according to claim 15, wherein each two vertical snap groove (132*b*) extends along the whole height of the base (30).

18. Single-piece moulded container (100) according to claim 14, wherein each two vertical snap groove (132*b*) has, in cross-section, a parallelepiped shape designed to match with a corresponding shape on the snapping member (144).

* * * * *